US009266124B2

(12) United States Patent
Humpal et al.

(10) Patent No.: US 9,266,124 B2
(45) Date of Patent: Feb. 23, 2016

(54) SPRAYER NOZZLE CARTRIDGE

(75) Inventors: Richard A. Humpal, Ankeny, IA (US); Travis G. Funseth, Ankeny, IA (US)

(73) Assignee: DEERE & COMPANY, Moline, IL (US)

( * ) Notice: Subject to any disclaimer, the term of this patent is extended or adjusted under 35 U.S.C. 154(b) by 595 days.

(21) Appl. No.: 13/457,664

(22) Filed: Apr. 27, 2012

(65) Prior Publication Data

US 2013/0284827 A1 Oct. 31, 2013

(51) Int. Cl.

| | |
|---|---|
| ***B05B 7/08*** | (2006.01) |
| ***B05B 1/14*** | (2006.01) |
| ***B05B 1/16*** | (2006.01) |
| ***B05B 15/06*** | (2006.01) |

(52) U.S. Cl.

CPC ..... *B05B 1/14* (2013.01); *B05B 1/1609* (2013.01); *B05B 1/169* (2013.01); *B05B 1/1636* (2013.01); *B05B 1/1645* (2013.01); *B05B 15/069* (2013.01)

(58) Field of Classification Search

USPC ..... 239/67, 159, 162, 170, 442, 549–551, 239/562, 565, 566, 581.1

See application file for complete search history.

(56) References Cited

U.S. PATENT DOCUMENTS

| | | | | |
|---|---|---|---|---|
| 2,680,652 | A * | 6/1954 | Kooistra | 239/493 |
| 3,779,533 | A * | 12/1973 | Etter | 239/394 |
| 3,826,431 | A * | 7/1974 | Telge | 239/551 |
| 3,863,841 | A * | 2/1975 | Berthoud | 239/266 |
| 4,058,260 | A * | 11/1977 | Lestradet | 239/394 |
| 4,666,085 | A | 5/1987 | Liaw | |
| 5,134,961 | A | 8/1992 | Giles et al. | |
| 5,183,322 | A | 2/1993 | Haruch | |
| 5,253,807 | A * | 10/1993 | Newbegin | 239/11 |
| 5,884,847 | A | 3/1999 | Christopher | |
| 6,126,088 | A * | 10/2000 | Wilger et al. | 239/170 |
| 7,124,964 | B2 | 10/2006 | Bui | |
| 7,578,454 | B2 * | 8/2009 | Joo | 239/488 |
| 7,861,946 | B2 | 1/2011 | Beeren | |
| 2002/0190140 | A1 * | 12/2002 | Arenson et al. | 239/391 |
| 2004/0007686 | A1 * | 1/2004 | Kingsford et al. | 251/335.3 |
| 2006/0108456 | A1 * | 5/2006 | Beeren | 239/600 |
| 2008/0087750 | A1 * | 4/2008 | Waddelow et al. | 239/550 |
| 2008/0245282 | A1 * | 10/2008 | Richards | 111/127 |
| 2009/0184182 | A1 * | 7/2009 | Beeren | 239/581.1 |

FOREIGN PATENT DOCUMENTS

| | | | |
|---|---|---|---|
| EP | 2606722 | A1 | 6/2013 |
| WO | 00/23198 | A1 | 4/2000 |

OTHER PUBLICATIONS

European Search Report in Counterpart Application No. 13165513.6, dated Mar. 25, 2014 (5 pages).

(Continued)

*Primary Examiner* — Len Tran
*Assistant Examiner* — Adam J Rogers

(57) ABSTRACT

A sprayer nozzle cartridge for a sprayer nozzle apparatus of an agricultural sprayer is disclosed. The sprayer nozzle cartridge is adapted for coupling to a nozzle connector of the sprayer nozzle apparatus and for receiving a fluid from the sprayer nozzle apparatus. The sprayer nozzle apparatus includes an apparatus housing for supporting the nozzle connector and a control element configured to control fluid flow. The sprayer nozzle cartridge includes a cartridge housing. A plurality of nozzle tips having a plurality of flow paths are coupled to the cartridge housing. The control element selectively communicates fluid to at least one of the plurality of flow paths.

20 Claims, 16 Drawing Sheets

(56) References Cited

OTHER PUBLICATIONS

U.S. Appl. No. 13/333,178, Title: Arrangement for Switching Nozzles on the Go for Controlling Spray Rate, filed Dec. 21, 2011.

U.S. Appl. No. 13/333,541, Title: Sprayer Pulsing Nozzle Flow Control Using Rotational Step Positions, filed Jan. 3, 2012.

Office Action issued in counterpart application No. EP13165513.6, dated Nov. 30, 2015 (4 pages).

* cited by examiner 50
85
75
70
60
100
90
10
55
15
65
80
95
35
40
45
30
20
25
25
25
35
40
45
30
65
80
95
55
60
90
70
100
75
85
50

385
400
370
375
390
360
350
355
365
380
395
310
335
340
345
321
323
323
323
320
323
323
315
330
335
340
345
365
380
395
355
350
360
375
390
370
385
400

SPRAYER NOZZLE CARTRIDGE

FIELD OF THE DISCLOSURE

The present disclosure generally relates to agricultural sprayers, and more particularly to a nozzle cartridge of agricultural sprayers.

BACKGROUND OF THE DISCLOSURE

In order to spray a fluid (e.g., fertilizer, pesticide, fungicide, insecticide) onto agricultural crops, agricultural sprayers commonly include a sprayer nozzle apparatus. The sprayer nozzle apparatus commonly includes a nozzle connector for supporting a nozzle having an orifice. The geometry of the orifice influences the flow rate, droplet size, and spray pattern. The flow rate through the orifice is mainly a function of the orifice geometry and the fluid pressure at the orifice (i.e., pressure just prior to the orifice). Since the orifice geometry is typically fixed, the most common way to influence the flow rate through the nozzle is by changing fluid pressure. Changing the fluid pressure at the nozzle to influence flow rate changes has become common place on sprayers in order to allow for variable vehicle speed. The flow rate is changed in proportion to the vehicle speed in order to keep the application rate the same.

However, using the traditional fixed orifice nozzle has some limitations. The pressure versus flow relationship is a squared function. To double the flow requires increasing the pressure by a factor of four times. Unfortunately, changing pressure also changes atomization dynamics resulting in an impact on spray quality. Spray quality characteristics, namely, droplet size and spray angle, both become smaller as pressure increases. These changes can negatively impact spray deposit and spray drift. So, the need for the ability to change nozzles on the go has emerged.

SUMMARY OF THE DISCLOSURE

In one embodiment, a sprayer nozzle cartridge is disclosed. The sprayer nozzle cartridge is adapted for coupling to a nozzle connector of a sprayer nozzle apparatus and for receiving a fluid from the sprayer nozzle apparatus. The sprayer nozzle apparatus includes an adjustable apparatus housing for supporting the nozzle connector and a control element configured to control fluid flow. The sprayer nozzle cartridge includes a cartridge housing. A first nozzle tip having a first flow path is coupled to the cartridge housing. A second nozzle tip having a second flow path is coupled to the cartridge housing. The control element selectively communicates fluid to at least one of the first flow path and the second flow path. The adjustable apparatus housing and the control element can be controlled manually, remotely, or automatically.

In another embodiment, a sprayer nozzle cartridge is disclosed. The sprayer nozzle cartridge is adapted for coupling to a nozzle connector of a sprayer nozzle apparatus and for receiving a fluid from the sprayer nozzle apparatus. The sprayer nozzle apparatus includes an adjustable apparatus housing for supporting the nozzle connector and a control element configured to control fluid flow. The sprayer nozzle cartridge includes a cartridge housing. A first nozzle tip having a first flow path is coupled to the cartridge housing. A second nozzle tip having a second flow path is coupled to the cartridge housing. A third nozzle tip having a third flow path is coupled to the cartridge housing. The control element selectively communicates fluid to at least one of the first flow path, the second flow path, and the third flow path. The adjustable apparatus housing and the control element can be controlled manually, remotely, or automatically.

In yet another embodiment, a sprayer nozzle cartridge is disclosed. The sprayer nozzle cartridge is adapted for coupling to a nozzle connector of a sprayer nozzle apparatus and for receiving a fluid from the sprayer nozzle apparatus. The sprayer nozzle apparatus includes an adjustable apparatus housing for supporting the nozzle connector and a control element configured to control fluid flow. The sprayer nozzle cartridge includes a cartridge housing. A plurality of nozzle tips having a plurality of flow paths are coupled to the cartridge housing. The sprayer nozzle cartridge includes a valve in fluid communication with the control element and the plurality of flow paths. The valve selectively communicates fluid to at least one of the plurality of flow paths. The adjustable apparatus housing and the control element can be controlled manually, remotely, or automatically.

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

DETAILED DESCRIPTION

Figure 1:
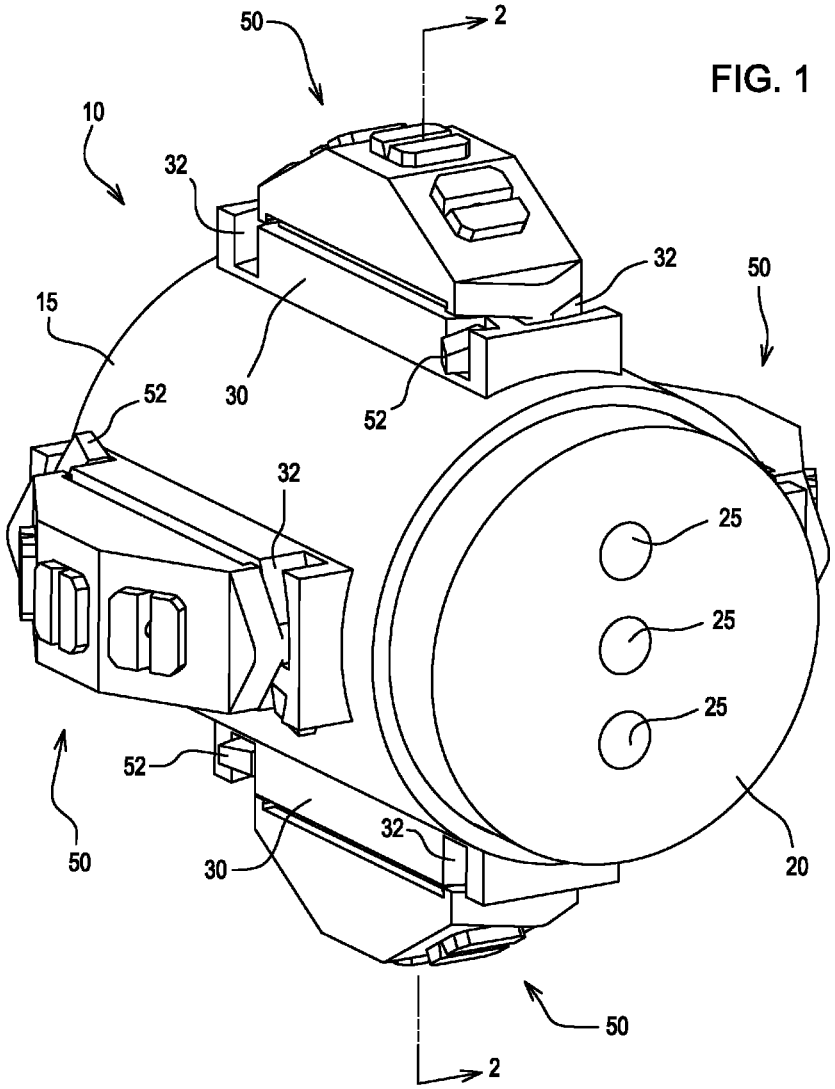
FIG. 1 is a perspective view of a sprayer nozzle apparatus including a plurality of sprayer nozzle cartridges according to one embodiment.

FIG. 1 illustrates a sprayer nozzle apparatus 10 of an agricultural sprayer (not shown) according to one embodiment. The illustrated sprayer nozzle apparatus 10 includes an adjustable apparatus housing 15.

A control element 20 is rotatably coupled to the adjustable apparatus housing 15 enabling the adjustable apparatus housing 15 to rotate relative to the control element 20. Exemplarily, the control element 20 has three fluid inlets 25. The three fluid inlets 25 are in fluid communication with a spray line containing a valve or valves (not shown) of an agricultural sprayer. Other types of control elements 20 are contemplated by this disclosure (e.g., ball valve).

Figure 2:
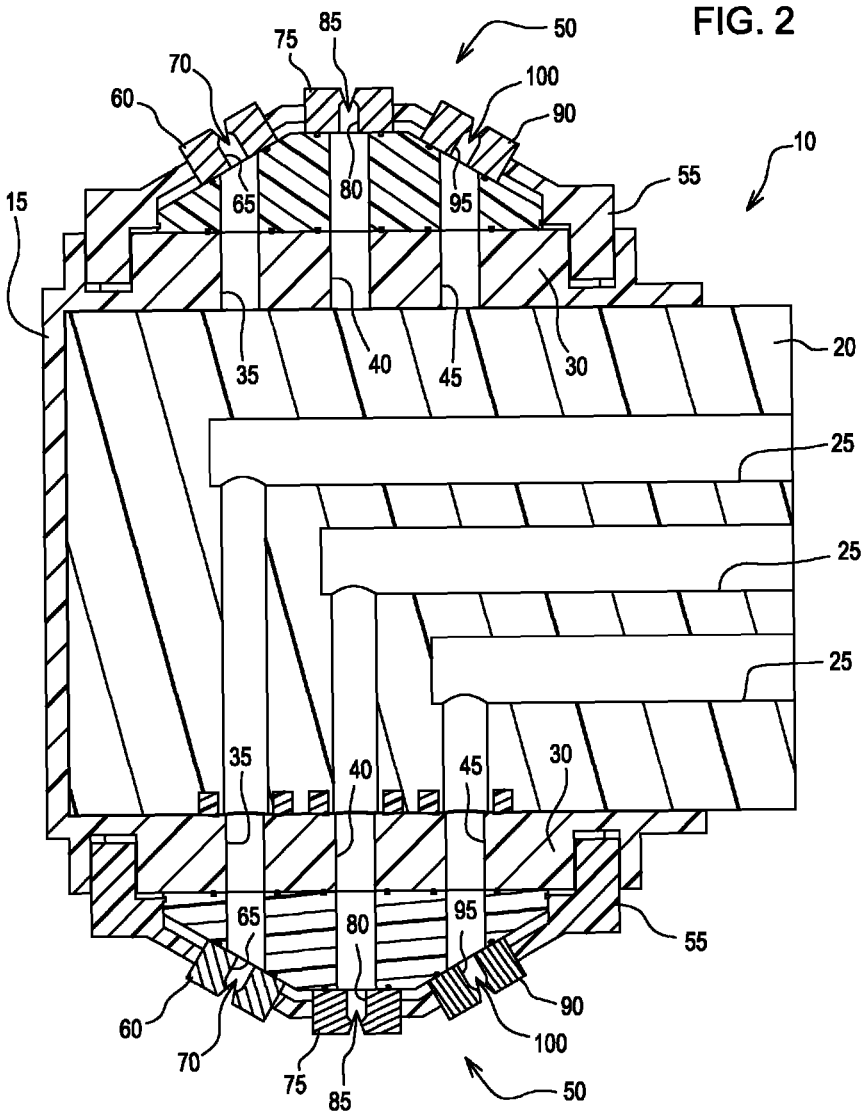
FIG. 2 is a sectional view taken along lines 2-2 of FIG. 1.

Exemplarily, four nozzle connectors 30 are coupled to the adjustable apparatus housing 15. With reference to FIG. 2, the nozzle connectors 30 have a first supply path 35, a second supply path 40, and a third supply path 45. Referring to FIG. 1, the nozzle connectors 30 have opposed slots 32 for receiving a sprayer nozzle cartridge 50.

The sprayer nozzle cartridge 50 includes protrusions 52 for releasably engaging the slots 32. With further reference to FIG. 2, the sprayer nozzle cartridge 50 includes a cartridge housing 55. A first nozzle tip 60 having a first flow path 65 and a first orifice 70 is coupled to the cartridge housing 55. The first flow path 65 is in fluid communication with the first supply path 35. A second nozzle tip 75 having a second flow path 80 and a second orifice 85 is coupled to the cartridge housing 55. The second flow path 80 is in fluid communication with the second supply path 40. A third nozzle tip 90 having a third flow path 95 and a third orifice 100 is coupled to the cartridge housing 55. The third flow path 95 is in fluid communication with the third supply path 45.

In operation, the control element 20 receives fluid from the spray line and selectively communicates fluid to the first supply path 35, the second supply path 40, and the third supply path 45, thereby communicating fluid to the first flow path 65, the second flow path 80, and the third flow path 95, respectively. The adjustable apparatus housing 15 rotates manually, remotely, or automatically to place the flow paths 65, 80, 95 of the desired sprayer nozzle cartridge 50 in fluid communication with the supply paths 35, 40, 45. The control element 20 may selectively communicate fluid to more than one supply path 35, 40, 45 or to none of the supply paths 35, 40, 45 depending on the orientation of the valve, or valves, in the spray line. It is contemplated by this disclosure that the control element 20 may change supply paths 35, 40, 45 while the agricultural sprayer is stationary or moving. It is also contemplated that the nozzle tips 60, 75, 90 may have orifices 70, 85, 100 with varying geometries in order to allow for varying vehicle speed and/or desired spray qualities. It is further contemplated that the adjustable apparatus housing 15 may rotate while the agricultural sprayer is stationary or moving.

FIGS. 3-6 illustrate a sprayer nozzle apparatus 110 of an agricultural sprayer (not shown) according to another embodiment. The sprayer nozzle apparatus 110 includes features similar to the sprayer nozzle apparatus 10 of FIGS. 1 and 2, and therefore, like components have been given like reference numerals plus 100 and only the differences between the sprayer nozzle apparatuses 10 and 110 will be discussed in detail below.

Figure 3:
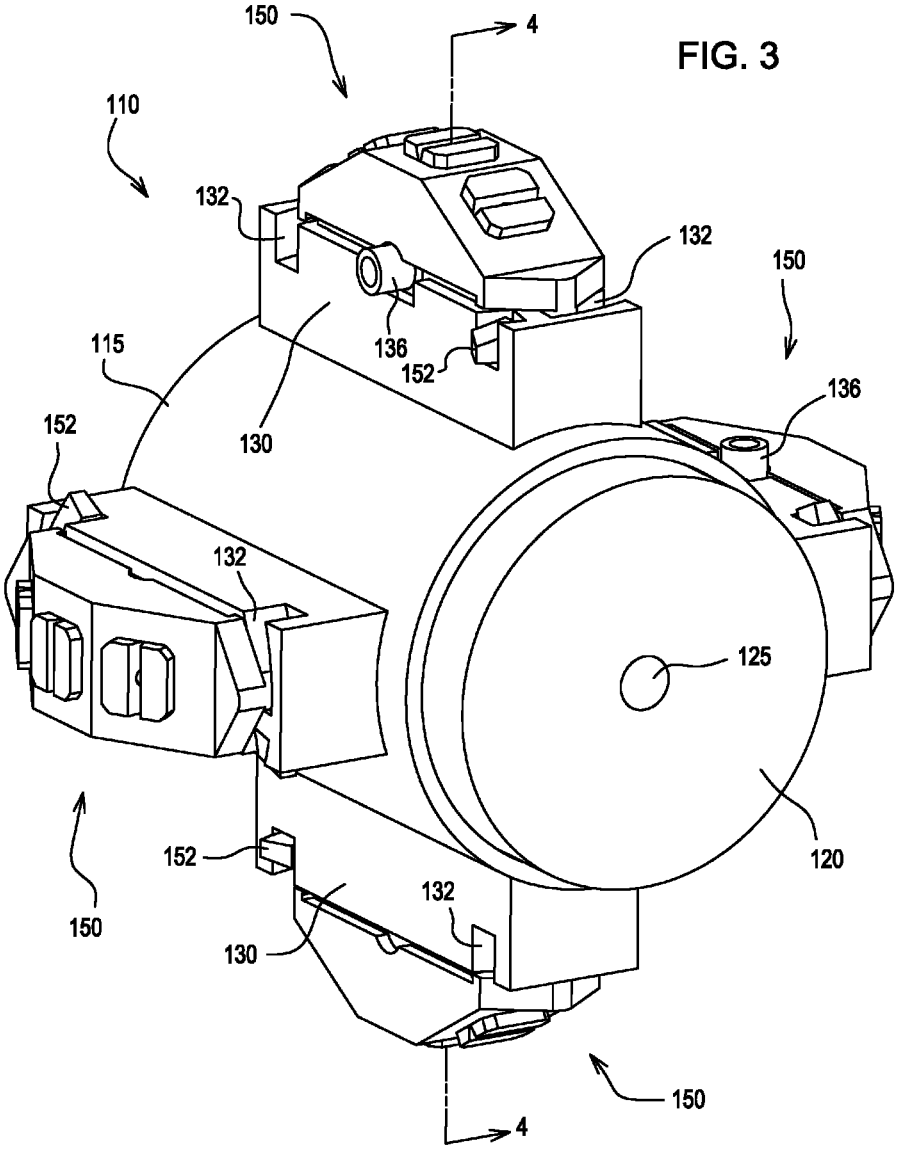
FIG. 3 is a perspective view of a sprayer nozzle apparatus including a plurality of sprayer nozzle cartridges according to another embodiment.
Figure 4:
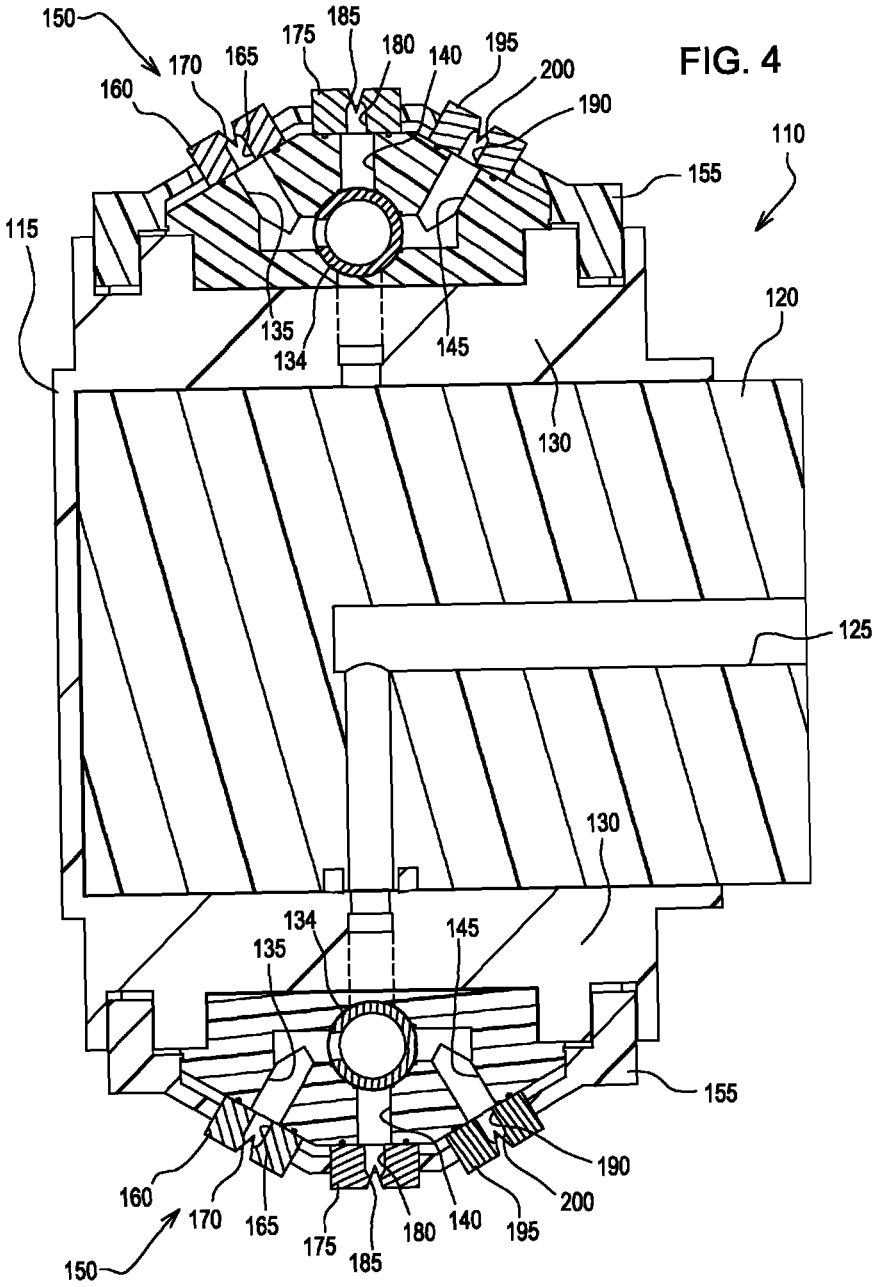
FIG. 4 is a sectional view taken along lines 4-4 of FIG. 3.
Figure 5:
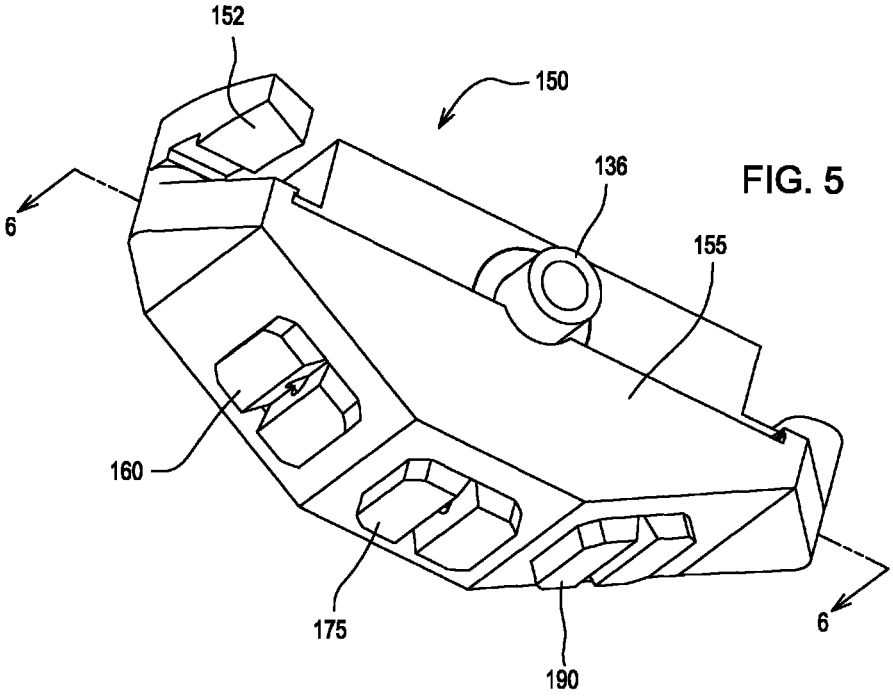
FIG. 5 is an enlarged perspective view of the sprayer nozzle cartridge of FIG. 3.
Figure 6:
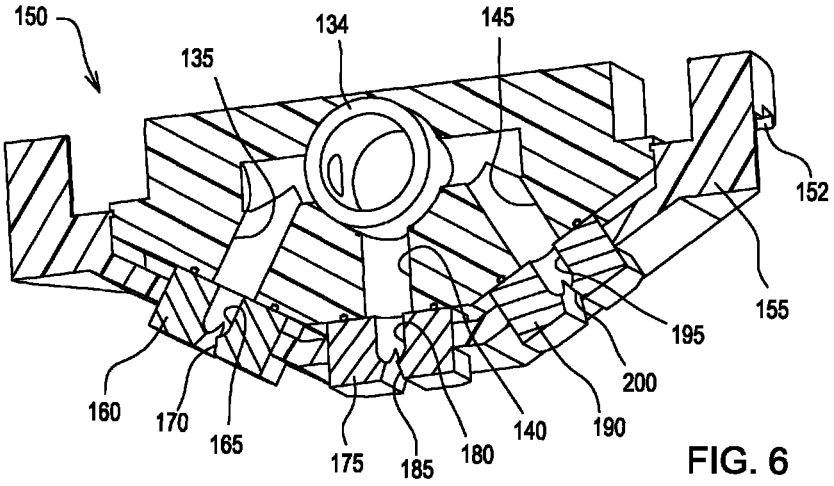
FIG. 6 is an enlarged sectional view taken along lines 6-6 of FIG. 5.

With reference to FIGS. 3 and 4, exemplarily, a control element 120 has one fluid inlet 125. The fluid inlet 125 is in fluid communication with a spray line (not shown) of an agricultural sprayer. The spray line may have a valve (not shown).

Referring to FIG. 4, a sprayer nozzle cartridge 150 includes a ball valve 134 having an adjustment portion 136 that receives fluid from the fluid inlet 125. The sprayer nozzle cartridge 150 includes a first supply path 135, a second supply path 140, and a third supply path 145.

In operation, the adjustment portion 136 is oriented by a positioning device (not shown) so the ball valve 134 selectively communicates fluid to at least one of the first supply path 135, the second supply path 140, and the third supply path 145, thereby communicating fluid to at least one of a first flow path 165, a second flow path 180, and a third flow path 195, respectively. Alternatively, the ball valve 134 may be other types of valves or control elements (e.g., cylindrical-shaped control valve, poppet, piezo control element).

Figure 7:
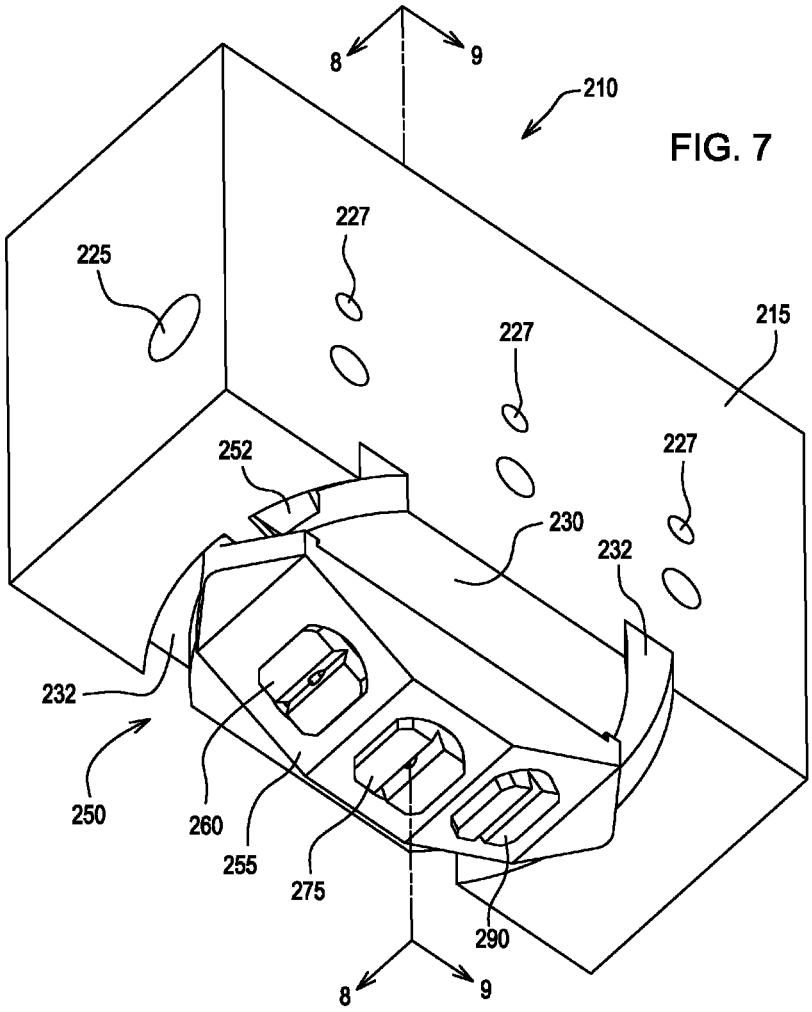
FIG. 7 is a perspective view of a sprayer nozzle apparatus including a sprayer nozzle cartridge according to yet another embodiment.
Figure 8:
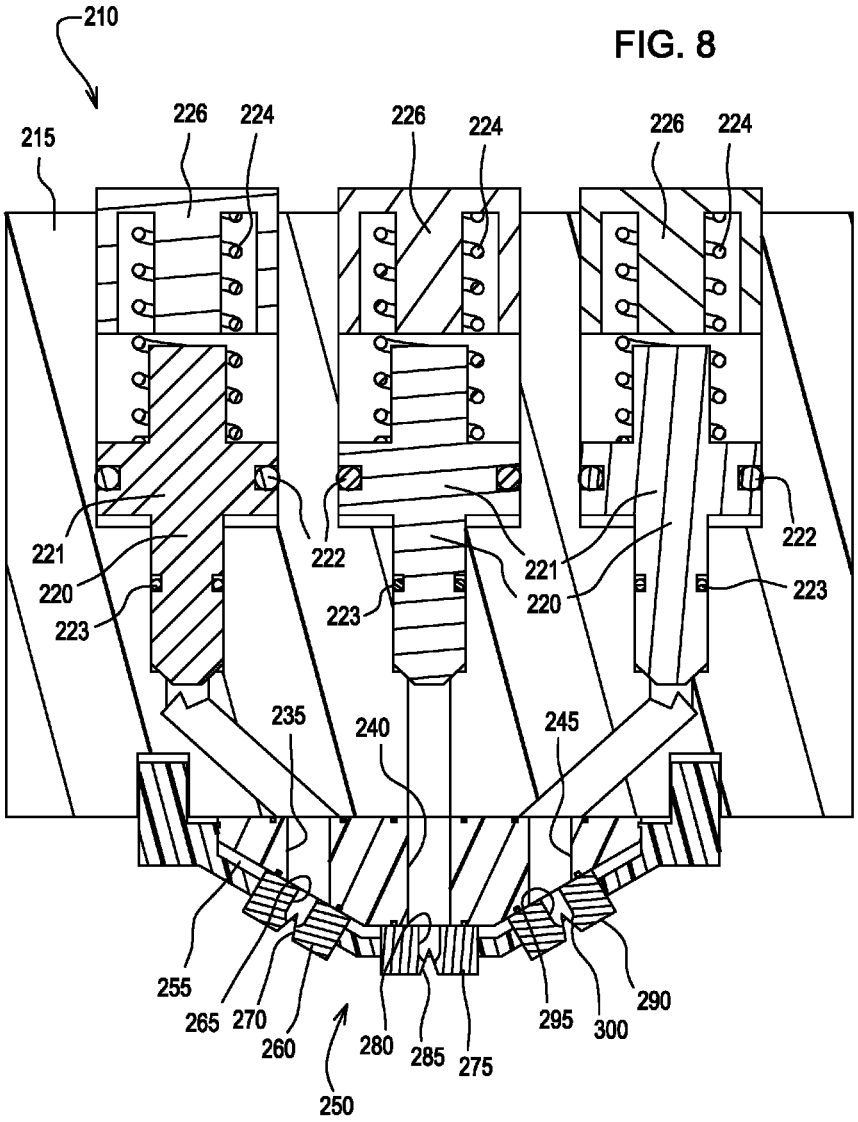
FIG. 8 is an enlarged sectional view taken along lines 8-8 of FIG. 7.
Figure 9:
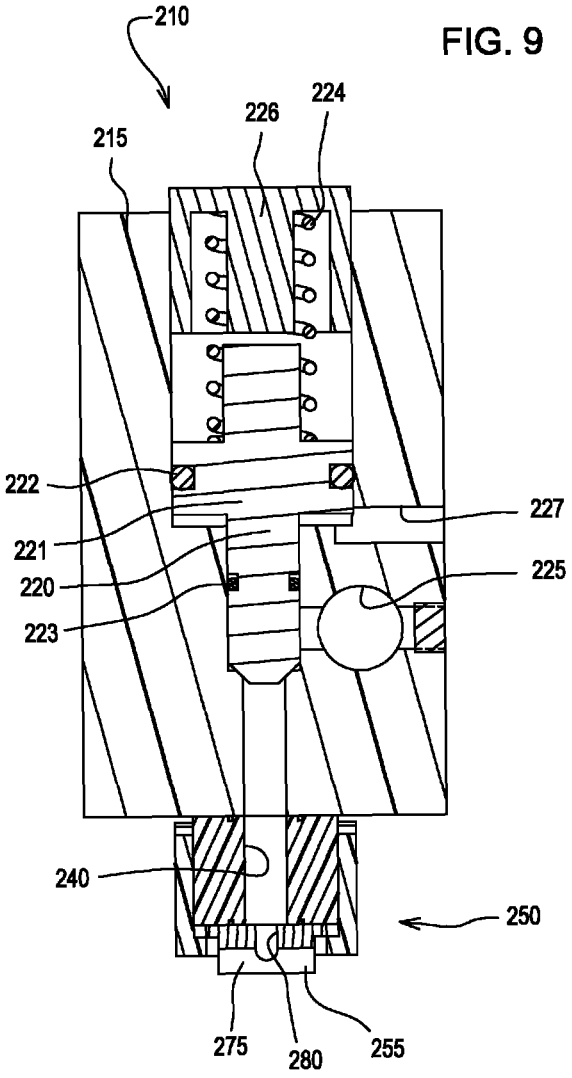
FIG. 9 is an enlarged sectional view taken along lines 9-9 of FIG. 7.

FIGS. 7-9 illustrate a sprayer nozzle apparatus 210 of an agricultural sprayer (not shown) according to another embodiment. The sprayer nozzle apparatus 210 includes features similar to the sprayer nozzle apparatus 10 of FIGS. 1 and 2, and therefore, like components have been given like reference numerals plus 200 and only the differences between the sprayer nozzle apparatuses 10 and 210 will be discussed in detail below.

Referring to FIG. 7, the sprayer nozzle apparatus 210 includes an apparatus housing 215 having a fluid inlet 225 and an air inlet 227. With reference to FIGS. 8 and 9, the sprayer nozzle apparatus 210 includes an adjustable control element 220 configured to control fluid flow. Exemplarily, the adjustable control element 220 has three air-actuated poppets 221 each with a first o-ring 222 and a second o-ring 223. A spring 224 biases the poppet 221 to prevent fluid flow. A cap 226 is threadably engaged with the apparatus housing 215 to secure the spring 224 within the apparatus housing 215.

With further reference to FIG. 7, a nozzle connector 230 having opposed slots 232 for receiving a sprayer nozzle cartridge 250 is coupled to the apparatus housing 215. The sprayer nozzle cartridge 250 includes protrusions 252 for releasably engaging the slots 232.

In operation, air is selectively passed through the air inlet 227 in order to activate one or more of the poppets 221 by counteracting the biasing force of the spring 224. Fluid is passed through the fluid inlet 225 and the adjustable control element 220 selectively communicates fluid to at least one of the first flow path 265, the second flow path 280, and the third flow path 295. The adjustable control element 220 may selectively communicate fluid to more than one flow path 265, 280, 295 or to none of the flow paths 265, 280, 295.

Figure 10:
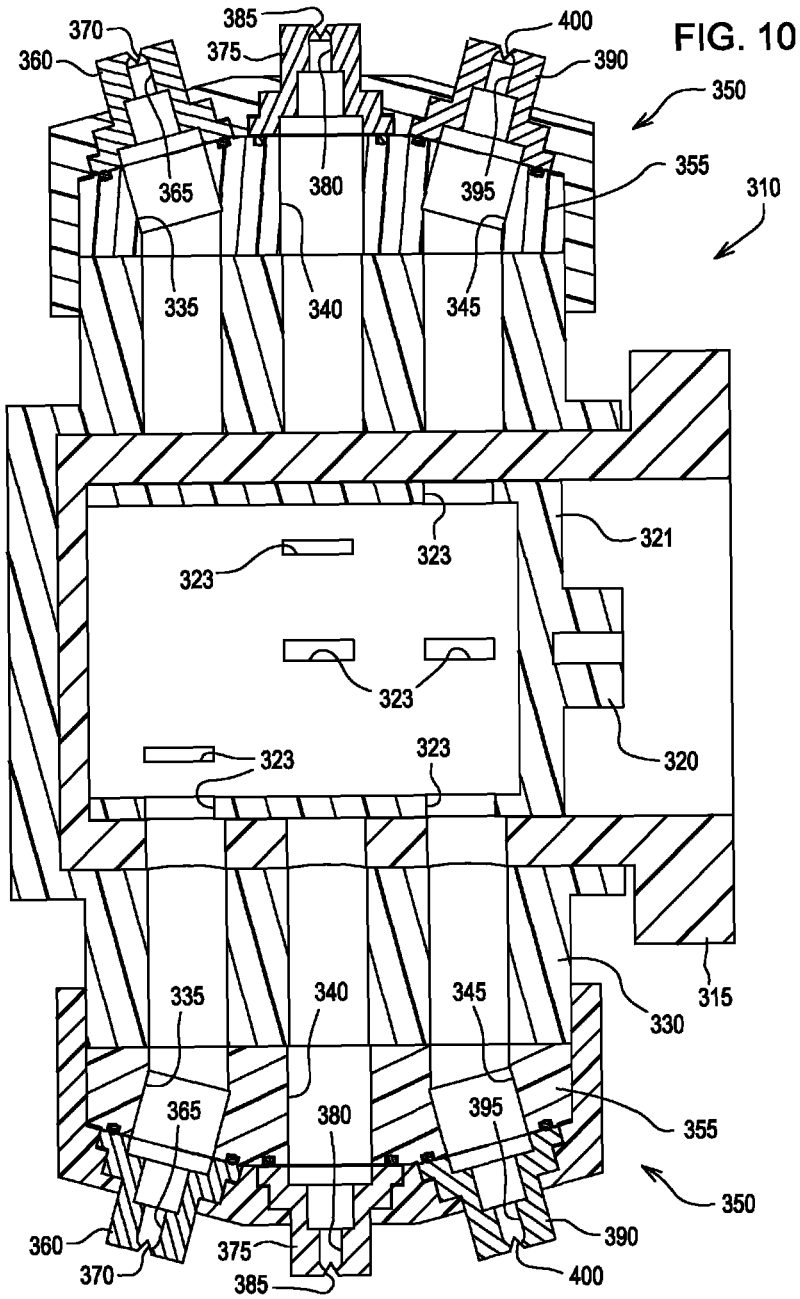
FIG. 10 is a sectional view of a sprayer nozzle apparatus including a sprayer nozzle cartridge according to another embodiment.

FIG. 10 illustrates a sprayer nozzle apparatus 310 of an agricultural sprayer (not shown) according to another embodiment. The sprayer nozzle apparatus 310 includes features similar to the sprayer nozzle apparatus 10 of FIGS. 1 and 2, and therefore, like components have been given like reference numerals plus 300 and only the differences between the sprayer nozzle apparatuses 10 and 310 will be discussed in detail below.

The sprayer nozzle apparatus 310 includes a control element 320 configured to control fluid flow. Exemplarily, the control element 320 has a rotor 321 with a plurality of slots 323.

In operation, the slots 323 of the control element 320 selectively communicate fluid to none or at least one of a first flow path 365, a second flow path 380, and a third flow path 395. The slots 323 of the control element 320 may selectively communicate fluid to more than one flow path 365, 380, 395 or to none of the flow paths 365, 380, 395.

Figure 11:
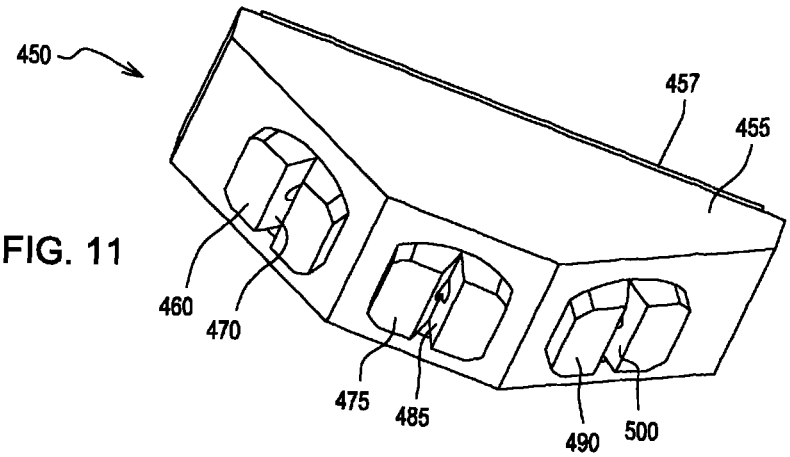
FIG. 11 is a perspective view of a sprayer nozzle cartridge according to yet another embodiment.
Figure 12:
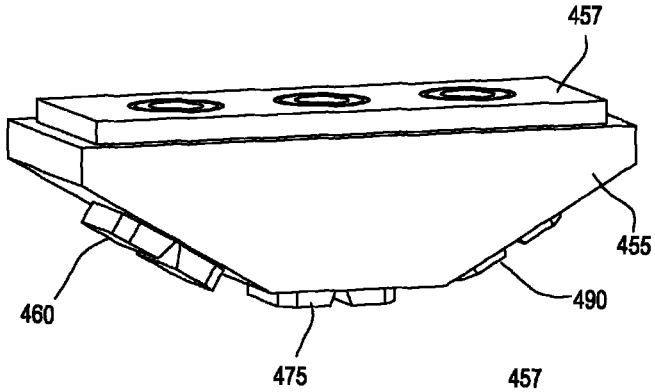
FIG. 12 is a perspective view of the sprayer nozzle cartridge of FIG. 11.
Figure 13:
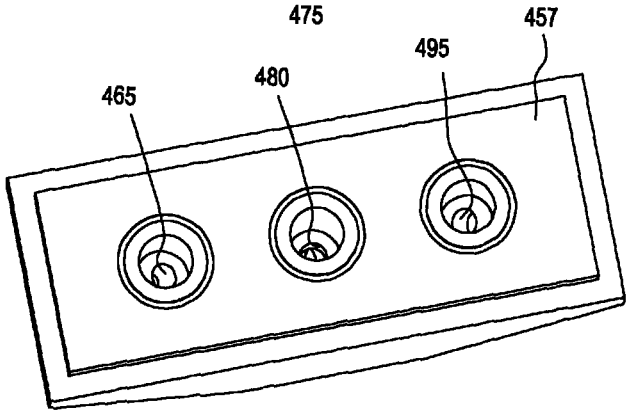
FIG. 13 is a bottom view of the sprayer nozzle cartridge of FIG. 11.

FIGS. 11-13 illustrate a sprayer nozzle cartridge 450 of an agricultural sprayer (not shown) according to another embodiment. The sprayer nozzle cartridge 450 includes features similar to the sprayer nozzle cartridge 50 of FIGS. 1 and 2, and therefore, like components have been given like reference numerals plus 400 and only the differences between the sprayer nozzle cartridges 50 and 450 will be discussed in detail below.

The sprayer nozzle cartridge 450 includes a cartridge housing 455 having a housing extension 457 that couples to a sprayer nozzle apparatus (not shown).

Figure 14:
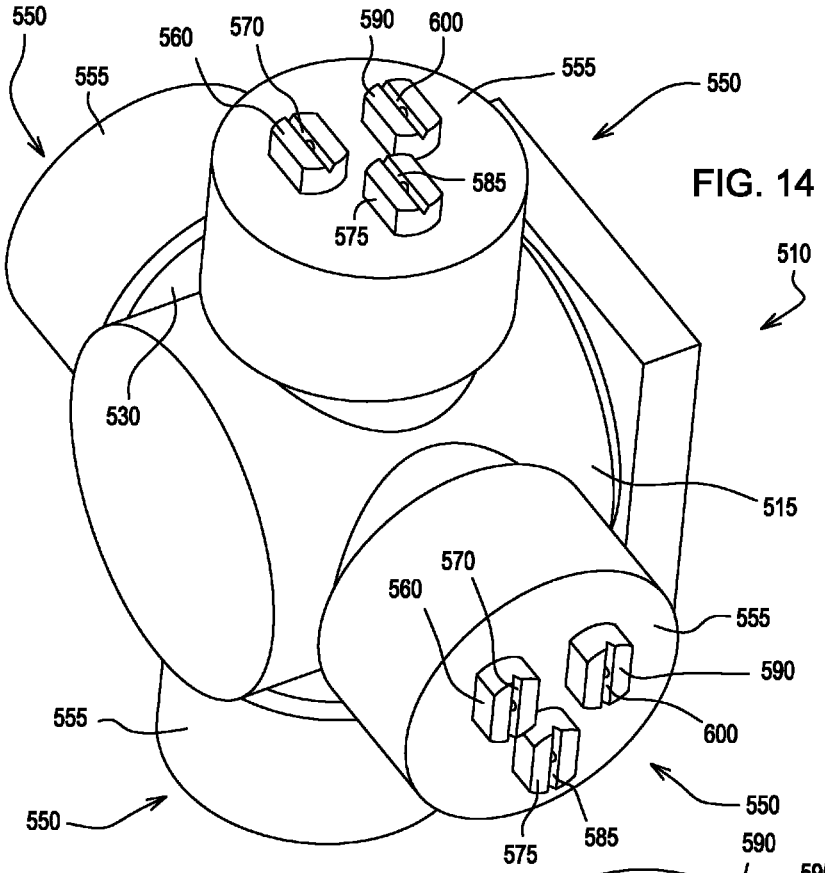
FIG. 14 is a perspective view of a sprayer nozzle apparatus including a plurality of sprayer nozzle cartridges according to another embodiment.
Figure 15:
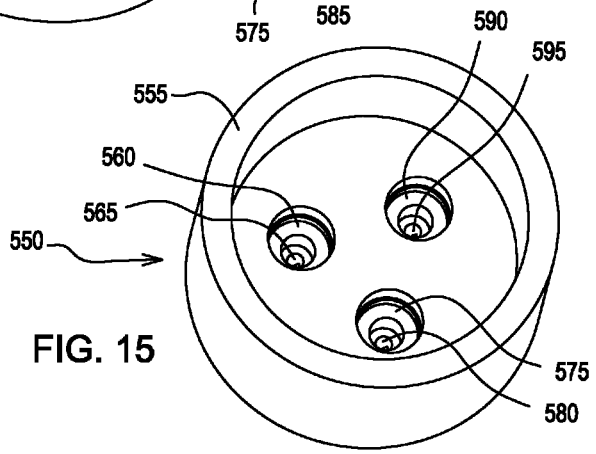
FIG. 15 is an enlarged bottom view of the sprayer nozzle cartridge of FIG. 14.

FIGS. 14 and 15 illustrate a sprayer nozzle apparatus 510 of an agricultural sprayer (not shown) according to another embodiment. The sprayer nozzle apparatus 510 includes features similar to the sprayer nozzle apparatus 10 of FIGS. 1 and 2, and therefore, like components have been given like reference numerals plus 500 and only the differences between the sprayer nozzle apparatuses 10 and 510 will be discussed in detail below.

The sprayer nozzle apparatus 510 includes an adjustable apparatus housing 515 for supporting four nozzle connectors 530. More or less nozzle connectors 530 may be used. The nozzle connectors 530 support a plurality of sprayer nozzle cartridges 550. Exemplarily, the sprayer nozzle cartridges 550 include a cylindrically-shaped cartridge housing 555. A first nozzle tip 560, a second nozzle tip 575, and a third nozzle tip 590 are coupled to the cylindrically-shaped cartridge housing 555 in a non-linear pattern. This disclosure contemplates that more or less nozzle tips 560, 575, 590 may be coupled to the cylindrically-shaped cartridge housing 555 in any pattern (e.g., linear, circular, square). This disclosure also contemplates that the nozzle connector 530 and the cylindrically-shaped cartridge housing 555 may be any shape (e.g., square, rectangular, oblong).

Figure 16:
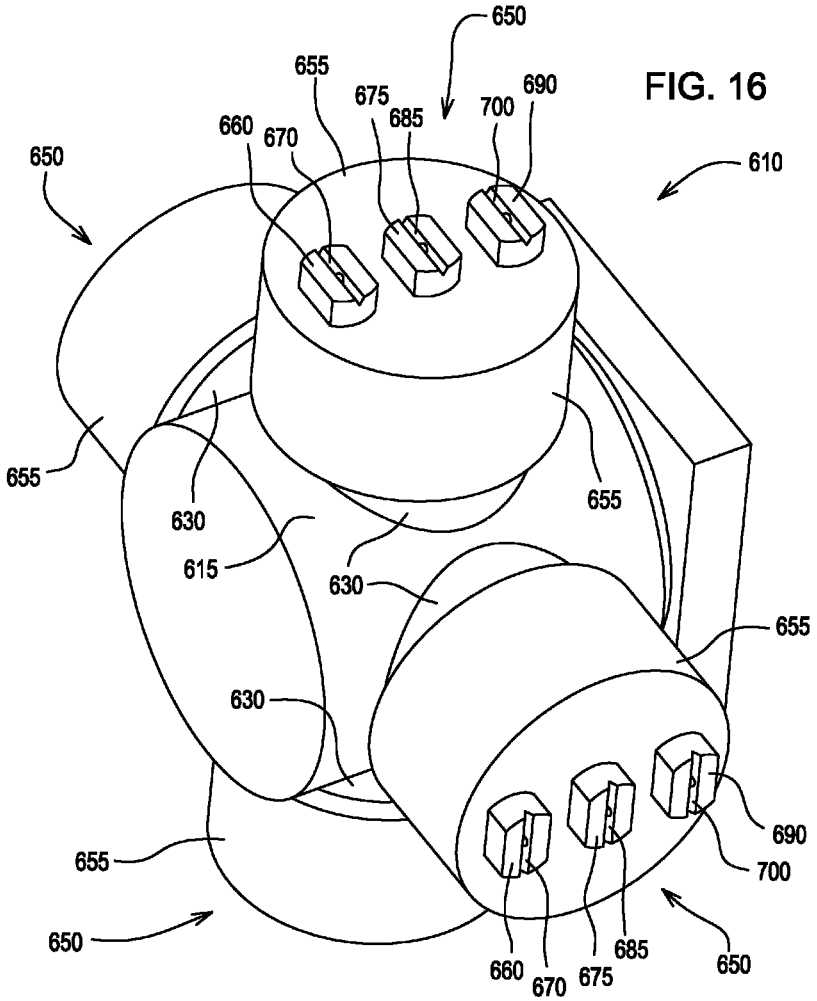
FIG. 16 is a perspective view of a sprayer nozzle apparatus including a plurality of sprayer nozzle cartridges according to yet another embodiment.

FIG. 16 illustrates a sprayer nozzle apparatus 610 of an agricultural sprayer (not shown) according to another embodiment. The sprayer nozzle apparatus 610 includes features similar to the sprayer nozzle apparatus 10 of FIGS. 1 and 2, and therefore, like components have been given like reference numerals plus 600 and only the differences between the sprayer nozzle apparatuses 10 and 610 will be discussed in detail below.

The sprayer nozzle apparatus 610 includes an adjustable apparatus housing 615 for supporting four nozzle connectors 630. More or less nozzle connectors 630 may be used. The nozzle connectors 630 support a plurality of sprayer nozzle cartridges 650. Exemplarily, the sprayer nozzle cartridges 650 include a cylindrically-shaped cartridge housing 655. A first nozzle tip 660, a second nozzle tip 675, and a third nozzle tip 690 are coupled to the cylindrically-shaped cartridge housing 655 in a linear pattern. This disclosure contemplates that the nozzle tips 660, 675, 690 may be coupled to the cylindrically-shaped cartridge housing 655 in any pattern (e.g., non-linear, circular, square). This disclosure also contemplates that the nozzle connector 630 and the cylindrically-shaped cartridge housing 655 may be any shape (e.g., square, rectangular, oblong).

Figure 17:
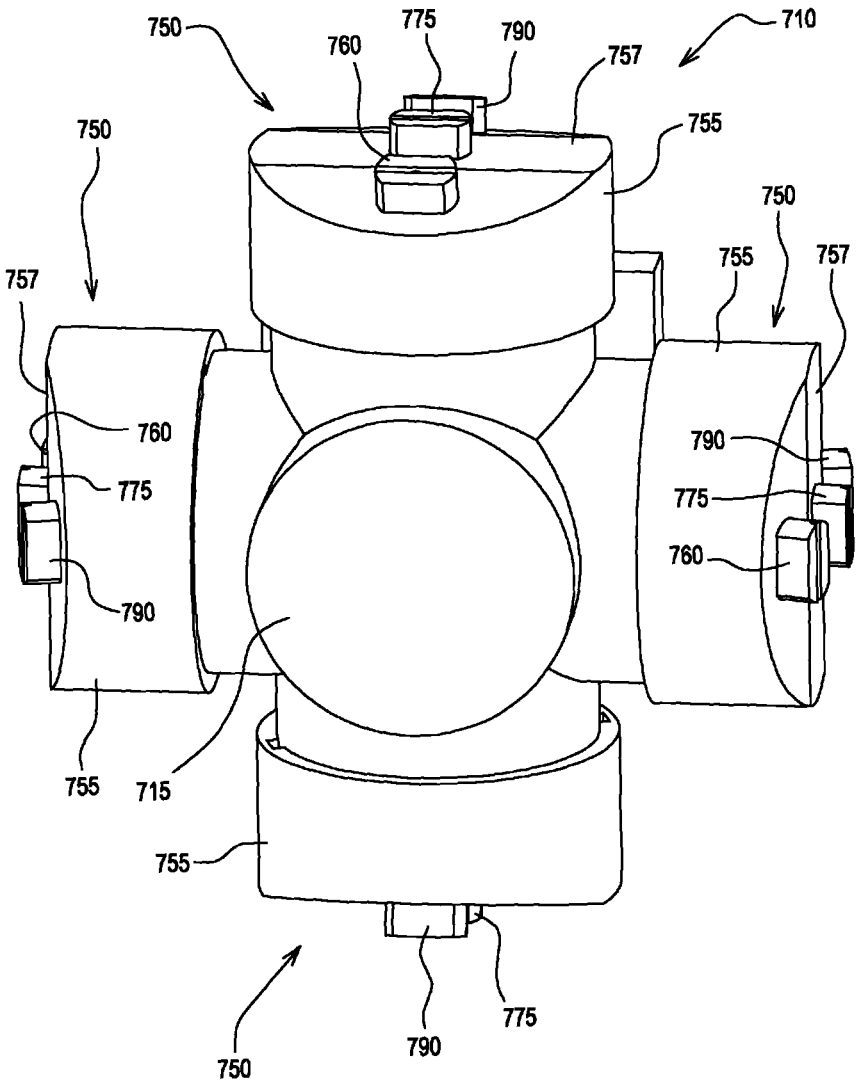
FIG. 17 is a perspective view of a sprayer nozzle apparatus including a plurality of sprayer nozzle cartridges according to another embodiment.
Figure 18:
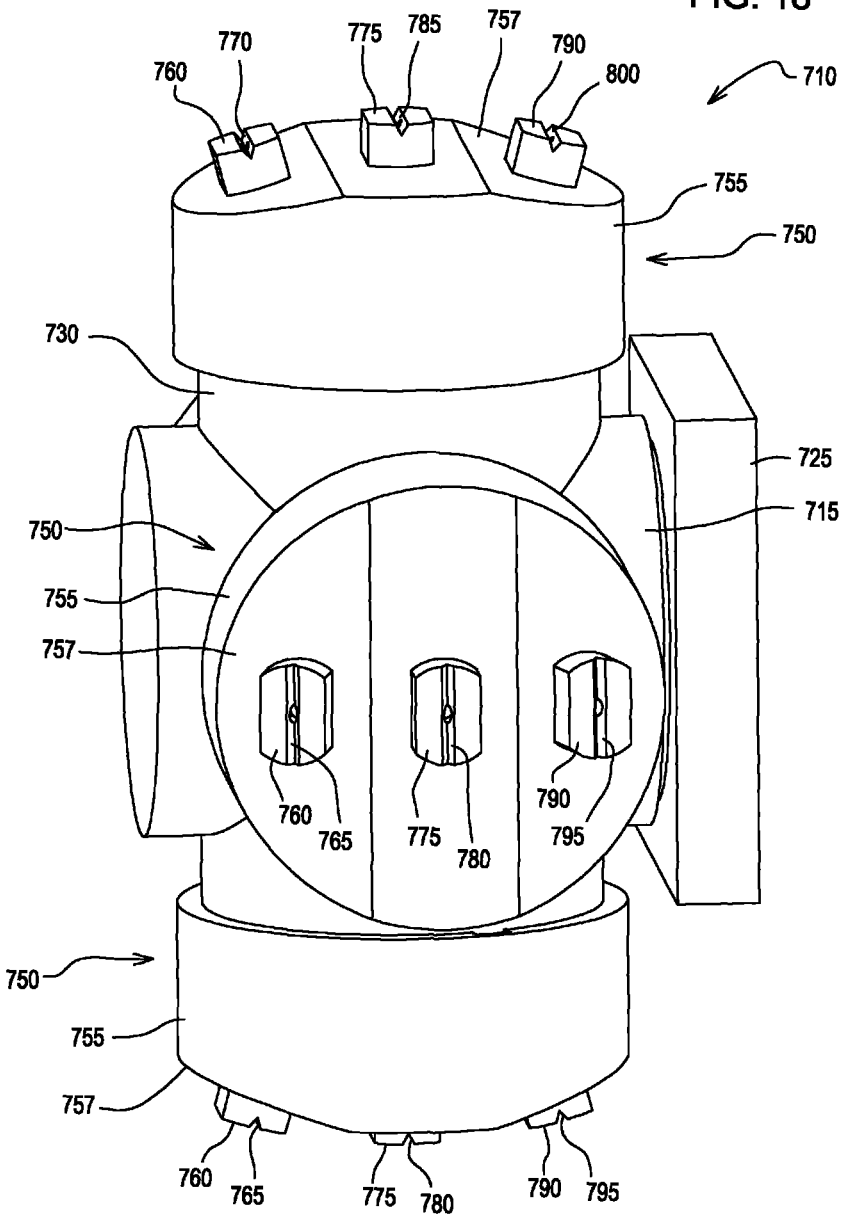
FIG. 18 is an enlarged right side view of the sprayer nozzle apparatus of FIG. 17.

FIGS. 17 and 18 illustrate a sprayer nozzle apparatus 710 of an agricultural sprayer (not shown) according to another embodiment. The sprayer nozzle apparatus 710 includes features similar to the sprayer nozzle apparatus 10 of FIGS. 1 and 2, and therefore, like components have been given like reference numerals plus 700 and only the differences between the sprayer nozzle apparatuses 10 and 710 will be discussed in detail below.

Referring to FIG. 18, the sprayer nozzle apparatus 710 includes an adjustable apparatus housing 715 having a fluid inlet 725 and supporting four nozzle connectors 730. More or less nozzle connectors 730 may be used. The nozzle connectors 730 support a plurality of sprayer nozzle cartridges 750. Exemplarily, the sprayer nozzle cartridges 750 include a cylindrically-shaped cartridge housing 755 having an overall convex surface 757. A first nozzle tip 760, a second nozzle tip 775, and a third nozzle tip 790 are coupled to the cylindrically-shaped cartridge housing 755 in a linear pattern. This disclosure contemplates that the nozzle tips 760, 775, 790 may be coupled to the cylindrically-shaped cartridge housing 755 in any pattern (e.g., non-linear, circular, square). This disclosure also contemplates that the nozzle connectors 730 and the cylindrically-shaped cartridge housing 755 may be any shape (e.g., square, rectangular, oblong).

Figure 19:
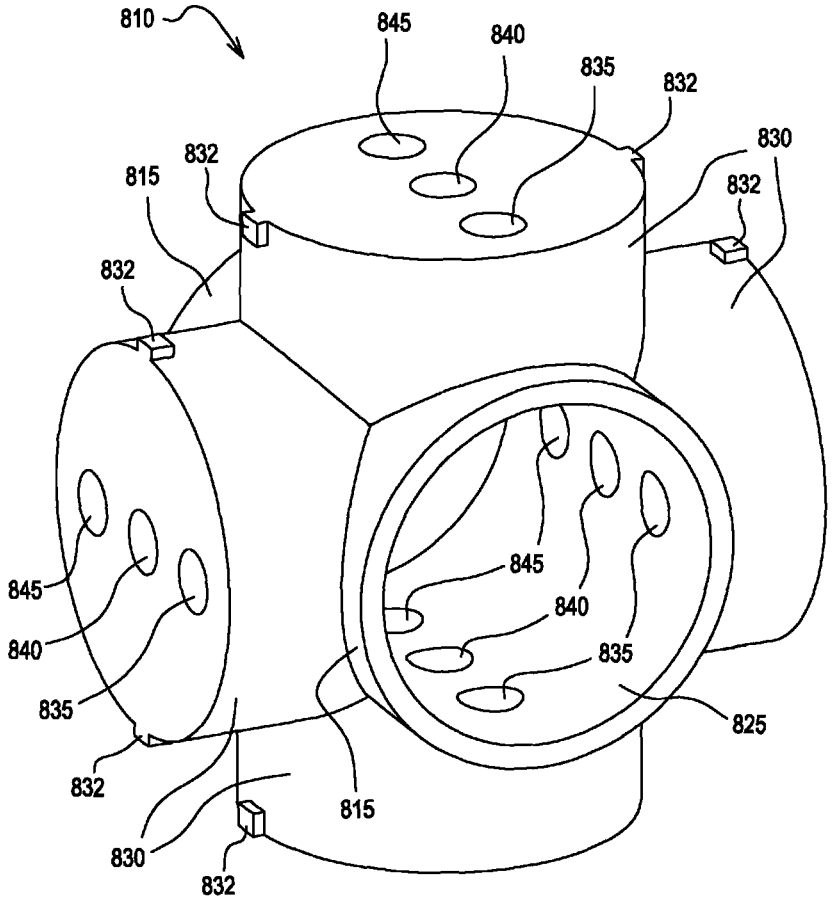
FIG. 19 is a perspective view of a portion of a sprayer nozzle apparatus according to yet another embodiment.
Figure 20:
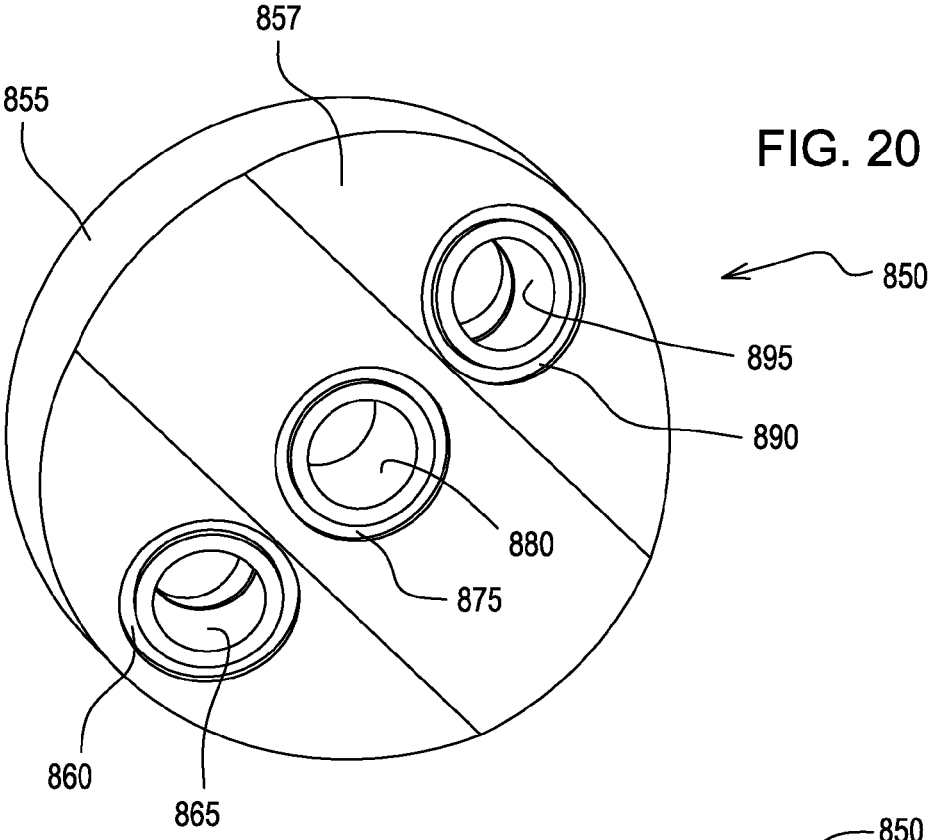
FIG. 20 is a perspective view of a sprayer nozzle cartridge according to another embodiment.
Figure 21:
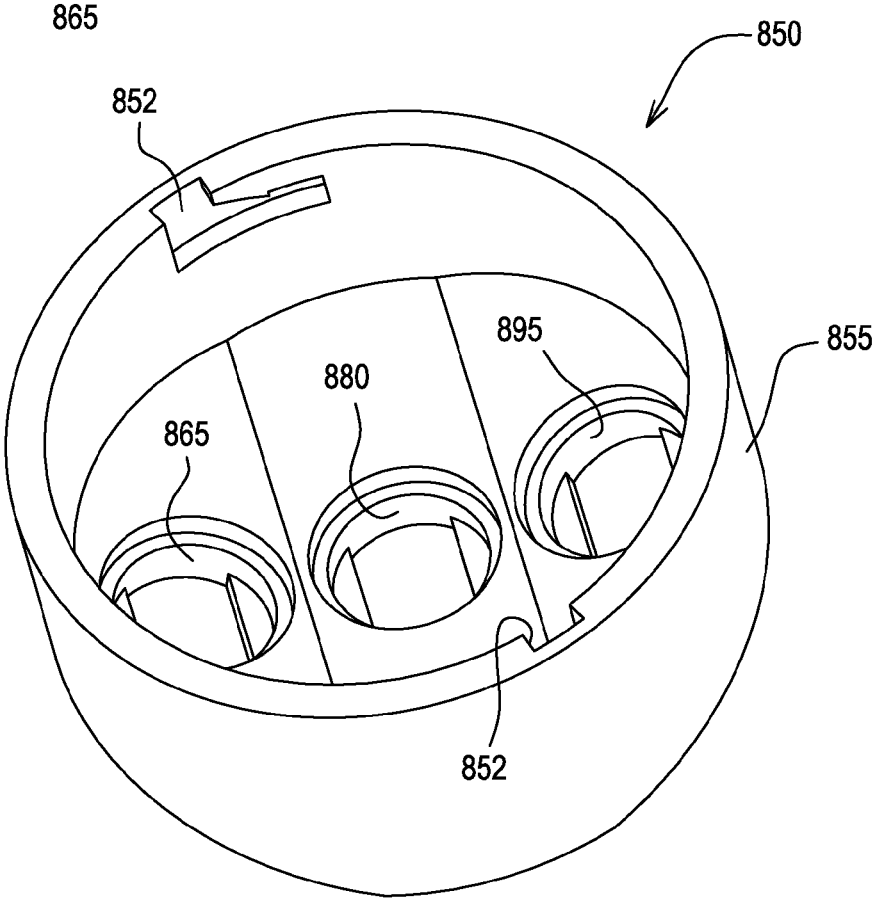
FIG. 21 is a perspective view of the sprayer nozzle cartridge of FIG. 20.

FIGS. 19-21 illustrate a sprayer nozzle apparatus 810 of an agricultural sprayer (not shown) according to another embodiment. The sprayer nozzle apparatus 810 includes features similar to the sprayer nozzle apparatus 10 of FIGS. 1 and 2, and therefore, like components have been given like reference numerals plus 800 and only the differences between the sprayer nozzle apparatuses 10 and 810 will be discussed in detail below.

With reference to FIG. 19, the sprayer nozzle apparatus 810 includes an adjustable apparatus housing 815 having a fluid inlet 825 and supporting four nozzle connectors 830. More or less nozzle connectors 830 may be used. The nozzle connectors 830 have protrusions 832 that are received by a sprayer nozzle cartridge 850 (FIG. 20). Referring to FIG. 21, the sprayer nozzle cartridge 850 includes slots 852 for releasably engaging the protrusions 832.

With further reference to FIG. 20, exemplarily, the sprayer nozzle cartridges 850 include a cylindrically-shaped cartridge housing 855 having an overall convex surface 857. A first nozzle tip 860 having a first flow path 865, a second nozzle tip 875 having a second flow path 880, and a third nozzle tip 890 having a third flow path 895 are coupled to the cylindrically-shaped cartridge housing 855 in a linear pattern. This disclosure contemplates that the nozzle tips 860, 875, 890 may be coupled to the cylindrically-shaped cartridge housing 855 in any pattern (e.g., non-linear, circular, square). This disclosure also contemplates that the nozzle connector 830 (FIG. 19) and the cylindrically-shaped cartridge housing 855 may be any shape (e.g., square, rectangular, oblong).

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

Various features are set forth in the following claims.

What is claimed is:

1. A sprayer nozzle apparatus for use with an irrigation system; wherein the sprayer nozzle apparatus comprises, a sprayer nozzle cartridge adapted for coupling to a nozzle connector and receiving a fluid from the sprayer nozzle apparatus, an apparatus housing for supporting the nozzle connector and a control element configured to control fluid flow, the sprayer nozzle cartridge comprising:

a cartridge housing; a first nozzle tip comprising a first flow path, the first nozzle tip coupled to the cartridge housing;

a second nozzle tip comprising a second flow path, the second nozzle tip coupled to the cartridge housing; the cartridge housing including a plurality of protrusions for releasably engaging a plurality of slots in the control element of the sprayer nozzle apparatus; and wherein the control element selectively communicates the same fluid to at least one of the first flow path and the second flow path;

wherein a plurality of sprayer nozzle cartridges distributed circumferentially surrounding the sprayer nozzle apparatus;

wherein all flow paths in each of the plurality of sprayer nozzle cartridges conduct the same fluid, and wherein the sprayer nozzle apparatus has an inlet that is in fluid communication with a spray line.

2. The sprayer nozzle cartridge of claim 1, wherein the control element is configured to selectively communicate the same fluid to the first flow path.

3. The sprayer nozzle cartridge of claim 1, wherein the plurality of sprayer nozzle cartridges are distributed uniformly around an outer circumferential surface of the sprayer nozzle apparatus.

4. The sprayer nozzle cartridge of claim 1, wherein the control element is configured to selectively communicate the same fluid to both the first flow path and the second flow path.

5. The sprayer nozzle cartridge of claim 1, further comprising a third nozzle tip comprising a third flow path, the third nozzle tip coupled to the cartridge housing, wherein the control element selectively communicates the same fluid to at least one of the first flow path, the second flow path, and the third flow path.

6. The sprayer nozzle cartridge of claim 1, wherein the plurality of sprayer nozzle cartridges are attached around an outer cylinder of the sprayer nozzle apparatus.

7. The sprayer nozzle cartridge of claim 5, wherein the control element is configured to selectively communicate the same fluid to each of the first, second, and third flow paths.

8. The sprayer nozzle cartridge of claim 5, wherein the control element is configured to selectively communicate the same fluid to both the first flow path and the second flow path.

9. The sprayer nozzle cartridge of claim 5, wherein the control element is configured to selectively communicate the same fluid to both the first flow path and the third flow path.

10. The sprayer nozzle cartridge of claim 1, wherein the cartridge housing is cylindrical.

11. A sprayer nozzle apparatus for use with an irrigation system; wherein the sprayer nozzle apparatus comprises, a sprayer nozzle cartridge adapted for coupling to a nozzle connector and receiving a fluid from the sprayer nozzle apparatus, an apparatus housing for supporting the nozzle connector and a control element configured to control fluid flow, the sprayer nozzle cartridge comprising:

a cartridge housing; a first nozzle tip comprising a first flow path, the first nozzle tip coupled to the cartridge housing; a second nozzle tip comprising a second flow path, the second nozzle tip coupled to the cartridge housing; a third nozzle tip comprising a third flow path, the third nozzle tip coupled to the cartridge housing; the cartridge housing including a plurality of protrusions for releasably engaging a plurality of slots in the control element of the sprayer nozzle apparatus; and wherein the control element selectively communicates the same fluid to at least one of the first flow path, the second flow path, and the third flow path; wherein multiple sprayer nozzle cartridges are symmetrically encircling the sprayer nozzle apparatus; wherein all flow paths in the multiple sprayer nozzle cartridges conduct the same fluid; and wherein the control element has an inlet that is in fluid communication with a spray line.

12. The sprayer nozzle cartridge of claim 11, wherein the control element is configured to selectively communicate the same fluid to each of the first, second, and third flow paths.

13. The sprayer nozzle cartridge of claim 11, wherein the control element is configured to selectively communicate the same fluid to the first flow path.

14. The sprayer nozzle cartridge of claim 11, wherein the multiple sprayer nozzle cartridges uniformly encircle around a circumferential surface of the sprayer nozzle apparatus.

15. The sprayer nozzle cartridge of claim 11, wherein the first nozzle tip, the second nozzle tip and the third nozzle tip form a triangular pattern on the sprayer nozzle cartridge.

16. The sprayer nozzle cartridge of claim 11, wherein the control element is configured to selectively communicate the same fluid to both the first flow path and the second flow path.

17. The sprayer nozzle cartridge of claim 11, wherein the first nozzle tip, the second nozzle tip and the third nozzle tip form a linear pattern on the sprayer nozzle cartridge.

18. The sprayer nozzle cartridge of claim 11, wherein the control element is configured to selectively communicate fluid to both the second flow path and the third flow path; and the control element comprises air-actuated poppets.

19. A sprayer nozzle apparatus for use with an irrigation system; wherein the sprayer nozzle apparatus comprises, a sprayer nozzle cartridge connected to a nozzle connector and the sprayer nozzle cartridge and receiving a fluid from the sprayer nozzle apparatus, an apparatus housing for connected to the nozzle connector and a control element configured to control fluid flow, the sprayer nozzle cartridge comprising:

a cartridge housing; a plurality of nozzle tips comprising a plurality of flow paths, the plurality of nozzle tips connected to the cartridge housing; the cartridge housing including a plurality of protrusions for releasably engaging a plurality of slots in the control element of the sprayer nozzle apparatus;

a valve in fluid communication with the control element and the plurality of flow paths; wherein the valve selectively communicates the same fluid to at least one of the plurality of flow paths; wherein all flow paths in the sprayer nozzle cartridge conduct the same fluid; and wherein a plurality of sprayer nozzle cartridges are distributed symmetrically around a periphery of the sprayer nozzle apparatus; wherein the control element is attached to the apparatus housing; and wherein the control element is in fluid communication with a spray line.

20. The sprayer nozzle cartridge of claim 19, wherein the valve is configured to selectively communicate fluid to each of the plurality of flow paths.

* * * * *